US009989309B1

(12) United States Patent
Griffin et al.

(10) Patent No.: US 9,989,309 B1
(45) **Date of Patent: *Jun. 5, 2018**

(54) CONDENSER ASSEMBLY FOR AN APPARATUS FOR REMOVING LIQUID FROM A SUSPENSION

(71) Applicant: Gryphon Environmental, LLC, Owensboro, KY (US)

(72) Inventors: William Tid Smith Griffin, Hartford, KY (US); Chad Dean Estes, Lewisport, KY (US)

(73) Assignee: Gryphon Environment, LLC, Owensboro, KY (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/421,945

(22) Filed: Feb. 1, 2017

Related U.S. Application Data

(60) Provisional application No. 62/289,425, filed on Feb. 1, 2016.

(51) Int. Cl.

| | |
|---|---|
| ***F26B 23/00*** | (2006.01) |
| ***F26B 17/04*** | (2006.01) |
| ***F26B 17/00*** | (2006.01) |
| ***F26B 25/00*** | (2006.01) |

(52) U.S. Cl.
CPC ..... *F26B 23/004* (2013.01); *F26B 17/008* (2013.01); *F26B 17/04* (2013.01); *F26B 25/007* (2013.01)

(58) Field of Classification Search
CPC ..... F26B 23/004; F26B 17/008; F26B 17/04; F26B 25/007
USPC ..... 34/76
See application file for complete search history.

(56) References Cited

U.S. PATENT DOCUMENTS

| | | | | |
|---|---|---|---|---|
| 2,742,708 | A * | 4/1956 | McCormick | D06F 58/02 34/60 |
| 3,673,822 | A * | 7/1972 | Fleissner | D06B 3/16 68/19.1 |
| 3,685,167 | A * | 8/1972 | Loveday | D21F 5/00 34/635 |
| 3,693,382 | A * | 9/1972 | Grantham | D01B 3/08 68/96 |
| 3,941,425 | A * | 3/1976 | Reichl | B65G 53/30 137/355.17 |
| 4,991,912 | A * | 2/1991 | Fox | B65F 1/00 312/236 |
| 5,565,112 | A * | 10/1996 | Bratten | B01D 29/096 210/387 |

(Continued)

FOREIGN PATENT DOCUMENTS

| | | | |
|---|---|---|---|
| DE | 84 37 357.1 | * 3/1985 | |
| WO | WO 2010039250 A1 | * 4/2010 | B01D 1/14 |

*Primary Examiner* — Stephen M Gravini
(74) *Attorney, Agent, or Firm* — Stites & Harbison, PLLC; David W. Nagle, Jr.; James R. Hayne

(57) ABSTRACT

A condenser assembly comprises: a main cabinet; one or more filters mounted to a filter frame that is moveable between a first (operating) position within the main cabinet and a second (maintenance) position substantially outside of the main cabinet; and a condenser box that is moveable between a first (operating) position within the main cabinet and a second (maintenance) position substantially outside of the main cabinet. In some applications, the condenser assembly is part of an apparatus for removing liquid from a suspension.

17 Claims, 14 Drawing Sheets

(56) References Cited

U.S. PATENT DOCUMENTS

| | | | | |
|---|---|---|---|---|
| 5,632,097 | A * | 5/1997 | Snitchler | F26B 17/006 34/166 |
| 6,105,273 | A * | 8/2000 | Johanson | B01J 8/08 34/267 |
| 6,233,841 | B1 * | 5/2001 | Beach | A23L 3/54 34/203 |
| 6,901,990 | B2 * | 6/2005 | Howard | B22D 29/003 164/132 |
| 7,600,460 | B2 * | 10/2009 | Manders | F41B 9/0031 102/402 |
| 7,644,515 | B2 * | 1/2010 | Doh | D06F 58/22 34/603 |
| 7,694,432 | B2 * | 4/2010 | Eriksson | F26B 3/283 110/245 |
| 7,749,395 | B2 | 7/2010 | Griffin | |
| 7,987,616 | B2 * | 8/2011 | Bae | D06F 58/203 134/130 |
| 8,181,359 | B2 * | 5/2012 | Bae | D06F 58/203 134/22.12 |
| 8,673,156 | B2 * | 3/2014 | Griffin | B01D 1/14 210/175 |
| 8,726,533 | B2 * | 5/2014 | Cai | F26B 21/02 110/233 |
| 8,789,287 | B2 * | 7/2014 | Kim | D06F 58/22 34/480 |
| 8,806,771 | B2 * | 8/2014 | Holmes | B29B 13/065 219/388 |
| 8,991,140 | B2 * | 3/2015 | Dorn | A01D 46/20 280/209 |
| 9,341,410 | B1 * | 5/2016 | Griffin | F26B 17/00 |
| 2014/0161680 | A1 * | 6/2014 | Kantor | B01J 19/126 422/186.03 |
| 2014/0263769 | A1 * | 9/2014 | Lakhmiri | B02C 21/00 241/24.11 |

* cited by examiner

CONDENSER ASSEMBLY FOR AN APPARATUS FOR REMOVING LIQUID FROM A SUSPENSION

CROSS-REFERENCE TO RELATED APPLICATIONS

The present application claims priority to U.S. Patent Application Ser. No. 62/289,425 filed on Feb. 1, 2016, the entire disclosure of which is incorporated herein by reference.

BACKGROUND OF THE INVENTION

The present invention relates to a condenser assembly, which, in some applications, is part of an apparatus for removing liquid from a suspension.

Mixtures of liquids and solids, known as suspensions, present expensive disposal problems to the industries that generate them. Unprocessed suspensions typically cannot be disposed of in landfills due to regulations on water content. Even with more permissive regulations, it is much more expensive to transport and dispose of unprocessed suspensions as compared to solid components because transportation charges and landfill charges correspond to weight.

Additionally, the scope of potential uses of such suspensions is often substantially increased by removal of the liquid component from the solid component. Typically, the value of the dry solids arises from the decrease in weight occasioned by the removal of the liquid fraction, which leads to decreased disposal and transportation costs. The recovered dried solids may also be commercially valuable, such as if they are useable in other industrial and municipal applications (e.g., renewable fuel) or can be sold in secondary markets, such as in the case where the suspensions comprise paper, fiber, coal or mineral slurries.

Unfortunately, efforts to work around the suspension disposal problems often employ methods lacking environmental soundness. For example, many industries dump suspensions, such as waste products, into holding ponds, which are typically large concrete or plastic lined, man-made pools requiring acres of real estate. The suspensions then sit in these holding ponds while the solid materials settle at the bottom over time with the aid of only gravity. Aside from being a slow process, the potential for the pool lining to fail or result in contamination of the surrounding environment makes this a less-than-desirable solution in terms of both efficiency and environmental impact.

Industrial suspension ponds suffer from significant practical difficulties. For instance, holding ponds have a poor resulting yield (dry solid percentage content). Being passive, it also takes a long time to separate water from solids for a given volume of suspension, as compared to devices that rely on active separation. Keeping up with the output for any given suspension flow rate requires a greater area than if active separation systems are used. Two active separation systems, centrifuge processors and belt presses, each produce higher solid content yields than suspension ponds; however, they lack the ability to utilize thermodynamics to achieve 60-100% dry solid percentage yields. These active separation systems are also expensive to purchase and operate, and they are not readily scaled up or down to handle corresponding volumes of industrial suspension flow rates. The lack of portability and limitations on the amount of material which can be processed in a given time are also a significant limiting factor.

Certain drying technologies have been used to further remove water from suspensions processed by belt presses or screw presses. These drying technologies have focused on the use of thermal energy for removing water from the suspensions. For instance, drum dryers have been used; however, the technology is expensive in terms of both capital and operating costs. Belt dryers have also been used and promoted as a way of reducing footprint and costs. However, like drum dryers, belt dryers rely primarily on thermal energy to remove the water from a suspension by use of heat. Using heat to remove water requires large amounts of thermal energy to be available, which significantly adds to the operating costs of drying. In addition, both belt and drum dryers lack the ability of flexible throughputs, and also require large systems and high temperatures to operate.

In one attempt to address such limitations and disadvantages in the prior art, commonly assigned U.S. Pat. No. 9,341,410, which is incorporated herein by reference, describes an apparatus for removing liquid from a suspension. Such an apparatus comprises one or more drying chambers arranged in series. Each such drying chamber defines a substantially enclosed volume in which liquid is extracted from a suspension as it passes through the drying chamber. The apparatus further includes an internal conveyor system comprised of a conveyor belt and one or more rollers for driving the conveyor belt and transporting the suspension through the drying chambers at a substantially continuous speed. Such a conveyor belt is preferably manufactured from a material capable of withstanding the heat and pressure created within the drying chambers without significantly stretching, warping, tearing, or being otherwise rendered useless. Furthermore, the conveyor belt is preferably semi-permeable (i.e., perforated or porous), thus allowing liquids and gases to pass through the conveyor belt, while still supporting solids.

A suspension is loaded onto the conveyor belt at a first end of the conveyor belt. In each of the drying chambers, compressed and heated air is injected and applied in conjunction with a vacuum. In other words, air is pushed into and pulled from each of the drying chambers as the conveyor belt carries the suspension through the drying chambers.

With respect to the injection of air into each of the drying chambers, in some embodiments, air exits a blower and is routed via a hose to an air injection trunk line. Multiple air delivery hoses then connect the air injection trunk line to the lid of each of the drying chambers. In each drying chamber, air is then diffused by and distributed through one or more air distribution plates. The air contacts the suspension carried on the conveyor belt, and the air is then pulled through the suspension and the conveyor belt, exiting through a vacuum pipe. As a result of the application of the vacuum, the air further expands from its compressed state, through atmospheric conditions, into a negative pressure, such that the flow rate is significantly increased as the air passes through the suspension. In short, the positive-pressure injection of air into the drying chambers, combined with the vacuum pressure applied to the drying chambers, creates a pressure differential that causes rapid air expansion and increased air flow through the suspension. This facilitates efficient removal of liquid from the suspension, as there is an element of force drawing the liquid from the suspension, along with heat transfer. Thus, as the air passes through the suspension, the air becomes heavily saturated.

The heavily saturated air is then delivered to a condenser. In the condenser, the air reaches full saturation, and the liquid component (such as water) is drawn from the air as it cools and is collected in a water collection box associated with the condenser.

In some embodiments, the cooled air flows from the condenser back through the drying chambers via a series of pipes. The air is passed through the drying chambers in this manner to preheat and increase the temperature of the air. Such a preheating arrangement thus enables the use of heat that was not absorbed by the suspension to aid in the drying process.

The air is then returned to the blower. The blower again compresses and raises the temperature of the air, and the air is then again directed through the air injection trunk line to multiple air delivery hoses, and then directed into the respective drying chambers. Thus, the air is flowing through the apparatus in a closed loop (i.e., a recirculating air stream), such that the blower is also used to create the vacuum that draws air from each drying chamber.

In the present application, the focus is on the condenser (or condenser assembly) that may be used with such an apparatus for removing liquid from a suspension, or the condenser (or condenser assembly) may be used in other applications for removing a liquid component, such as water, from an air stream.

SUMMARY OF THE INVENTION

The present invention is a condenser assembly, which, in some applications, is part of an apparatus for removing liquid from a suspension.

An exemplary apparatus for removing liquid from a suspension made in accordance with the present invention comprises one or more drying chambers in which liquid is extracted from a suspension as it passes through the drying chamber. The apparatus also includes an internal conveyor system comprised of a continuous conveyor belt and one or more rollers for driving the conveyor belt and transporting the suspension continuously through the drying chambers.

In each of the drying chambers, compressed and heated air is injected and applied in conjunction with a vacuum. In other words, air is pushed into and pulled from each of the drying chambers, for example by a blower and vacuum pipe. The blower generates a positive pressure, which injects air into the respective drying chambers. The positive pressure generated by the blower acts to increase the temperature of the air, and it also acts to compress and decrease the volume of air that will be subsequently heated. The blower is also used to create the vacuum that draws air from each drying chamber, and thus, the vacuum pipe is operably connected to the intake of the blower. In other words, the air flows through the apparatus in a closed loop (i.e., a recirculating air stream).

In short, the positive-pressure injection of air into the drying chambers, combined with the vacuum pressure applied to the drying chambers, creates a pressure differential that causes rapid air expansion and acceleration of the air as it passes through the suspension. The expansion and acceleration of the air as it passes through the suspension enables moisture to be removed from the suspension by mass transfer. Accordingly, as the air passes through the suspension, the air becomes heavily saturated.

The heavily saturated air is then evacuated from the respective drying chambers and delivered to a condenser. The condenser assembly is designed to have a larger total volume (i.e., larger total diameter), such that the saturated air reduces its speed while in contact with the chilled surfaces of the condenser. Thus, in the condenser, the air reaches full saturation (100% relative humidity), and the liquid component (such as water) is drawn from the air as it cools. Cooled air then exits the condenser assembly with 100% relative humidity, but at a lower temperature (for example, 100° F.) under the vacuum pressure.

The cooled air flows from the condenser assembly to a blower filter box that provides filtration of the air prior to returning it to the blower. Again, as described above, the air is flowing through the apparatus in a closed loop (i.e., a recirculating air stream), such that the blower is also used to create the vacuum that draws air from each drying chamber. As a result, no exhausting of the air stream is necessary.

An exemplary condenser assembly for use with an apparatus for removing liquid from a suspension and made in accordance with the present invention generally comprises: a main cabinet; a filter frame and associated filters that are moveable between a first (operating) position within the main cabinet and a second (maintenance) position substantially outside of the main cabinet; and a condenser box that is similarly moveable between a first (operating) position within the main cabinet and a second (maintenance) position substantially outside of the main cabinet.

In some embodiments, the main cabinet includes a front wall which defines a first opening associated with the filter frame and a second opening associated with the condenser box. The main cabinet further defines a first interior cavity that is accessible via the first opening, which receives and houses the filter frame and associated filters in the first position. Similarly, the main cabinet also defines a second interior cavity that is accessible via the second opening, which receives and houses the condenser box in the first position.

In some embodiments, a first door selectively closes the first opening, and a second door selectively closes the second opening. In some embodiments, it is preferred that the first door and the second door each have a gasket or similar sealing means around its periphery to seal each door relative to the main cabinet when closed.

In some embodiments, an intermediate panel is positioned within the main cabinet between the first interior cavity and the second interior cavity, and the intermediate panel defines a passageway between the first interior cavity and the second interior cavity. Furthermore, a gasket is preferably positioned on the intermediate panel around the passageway and within the first interior cavity. The gasket is therefore positioned so as to seal the filter frame relative to the intermediate panel when the filter frame is in the first position. As such, in operation, all of the air entering the condenser assembly passes through the filters of the filter frame before entering the second interior cavity and contacting the condenser box.

To facilitate movement of the filter frame between the first position and the second position, in some embodiments, the filter frame includes a plurality of wheels located at the bottom of the filter frame and a guide plate located at the top of the filter frame. When the filter frame is in the first position within the first interior cavity of the main cabinet, the plurality of wheels of the filter frame engage a lower filter guide track located within the first interior cavity, and the guide plate engages an upper filter guide track located within the first interior cavity. However, after opening the door that selectively closes the first opening, a user can move the filter frame and associated filters from the first (operating) position within the first interior cavity of the main cabinet to the second (maintenance) position outside of the main cabinet, with the plurality of wheels facilitating such movement.

In some embodiments, the exemplary condenser assembly further includes a filter roller cart positioned outside of the main cabinet adjacent to the first opening. The filter roller cart includes a vertical support structure which is sized and configured to accept and maintain the filter frame in an upright position when outside of the main cabinet and multiple casters that engage the underlying ground surface.

The condenser box includes a frame and all of the coils and piping necessary for the condensing function and the removal of the liquid component (water) from the saturated air as it cools. In some embodiments, an inner roller conveyer is positioned within the second interior cavity of the main cabinet, which supports the condenser box in the first position. In some embodiments, an exterior roller conveyor extends from the second opening and is positioned outside of the main cabinet. The exterior roller conveyor supports the condenser box in the second position and is supported on multiple legs that engage the underlying ground surface. Thus, by opening the door that selectively closes the second opening, the condenser box can be withdrawn from the main cabinet of the condenser assembly, from the first (operating) position to the second (maintenance) position, over the respective first and second roller conveyors.

DETAILED DESCRIPTION OF THE INVENTION

Figure 1:
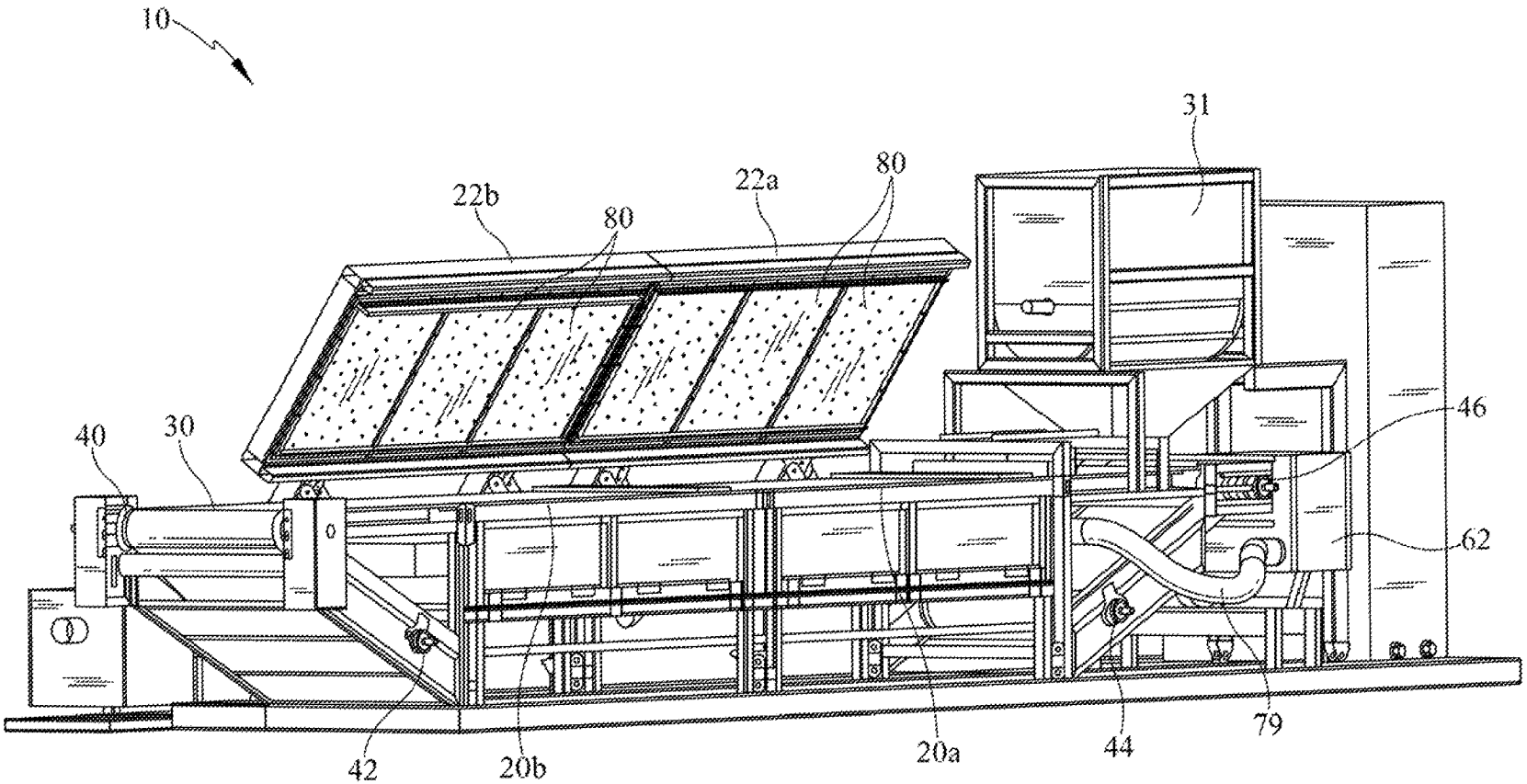
FIG. 1 is a perspective view of an exemplary apparatus for removing liquid from a suspension, including an exemplary condenser assembly made in accordance with the present invention, with the lids of the drying chambers of the apparatus open and in a raised position.

The present invention is a condenser assembly, which, in some applications, is part of an apparatus for removing liquid from a suspension.

FIGS. 1-4 are various views of an exemplary apparatus 10 for removing liquid from a suspension. The apparatus 10 comprises one or more drying chambers 20*a*, 20*b* arranged in series, with each drying chamber 20*a*, 20*b* defining a substantially enclosed volume in which liquid is extracted from a suspension as it passes through the drying chamber 20*a*, 20*b*, as further discussed below. The apparatus 10 also includes an internal conveyor system comprised of a continuous conveyor belt 30 and one or more rollers 40, 42, 44, 46 for driving the conveyor belt 30 and transporting the suspension continuously through the drying chambers 20*a*, 20*b*. Such a conveyor belt 30 is preferably manufactured from a material capable of withstanding the heat and pressure created within the drying chambers 20*a*, 20*b* without significantly stretching, warping, tearing, or being otherwise rendered useless. Furthermore, the conveyor belt 30 is preferably semi-permeable (i.e., perforated or porous), thus allowing liquids and gases to pass through the conveyor belt 30, while still supporting solids.

A suspension is loaded onto the conveyor belt 30 at a first end of the conveyor belt 30, for example, by a sifter 31, which is positioned at the first end of the conveyor belt 30 and meters the suspension onto the conveyor belt 30 while breaking the suspension into small particles (e.g., 2 to 4 millimeters in diameter) to increase the exposed surface area of the suspension being dried and to increase the porosity of the suspension to enable better air flow through the suspension. However, various other means of loading the suspension onto the conveyor belt 30 may be incorporated into the apparatus 10.

In each of the drying chambers 20*a*, 20*b*, compressed and heated air is injected and applied in conjunction with a vacuum. In other words, air is pushed into and pulled from each of the drying chambers 20*a*, 20*b*. In this exemplary embodiment, air is injected by a blower 66 via a hose 68 and air injection trunk line 60 into each of the drying chambers 20*a*, 20*b*. A vacuum pipe 70 then runs along the length of the drying chambers 20*a*, 20*b*, with one or more vacuum pipe segments 71 extending from the vacuum pipe 70 into the bottom of each of the drying chambers 20*a*, 20*b*, drawing air from the respective drying chambers 20*a*, 20*b*.

Figure 4:
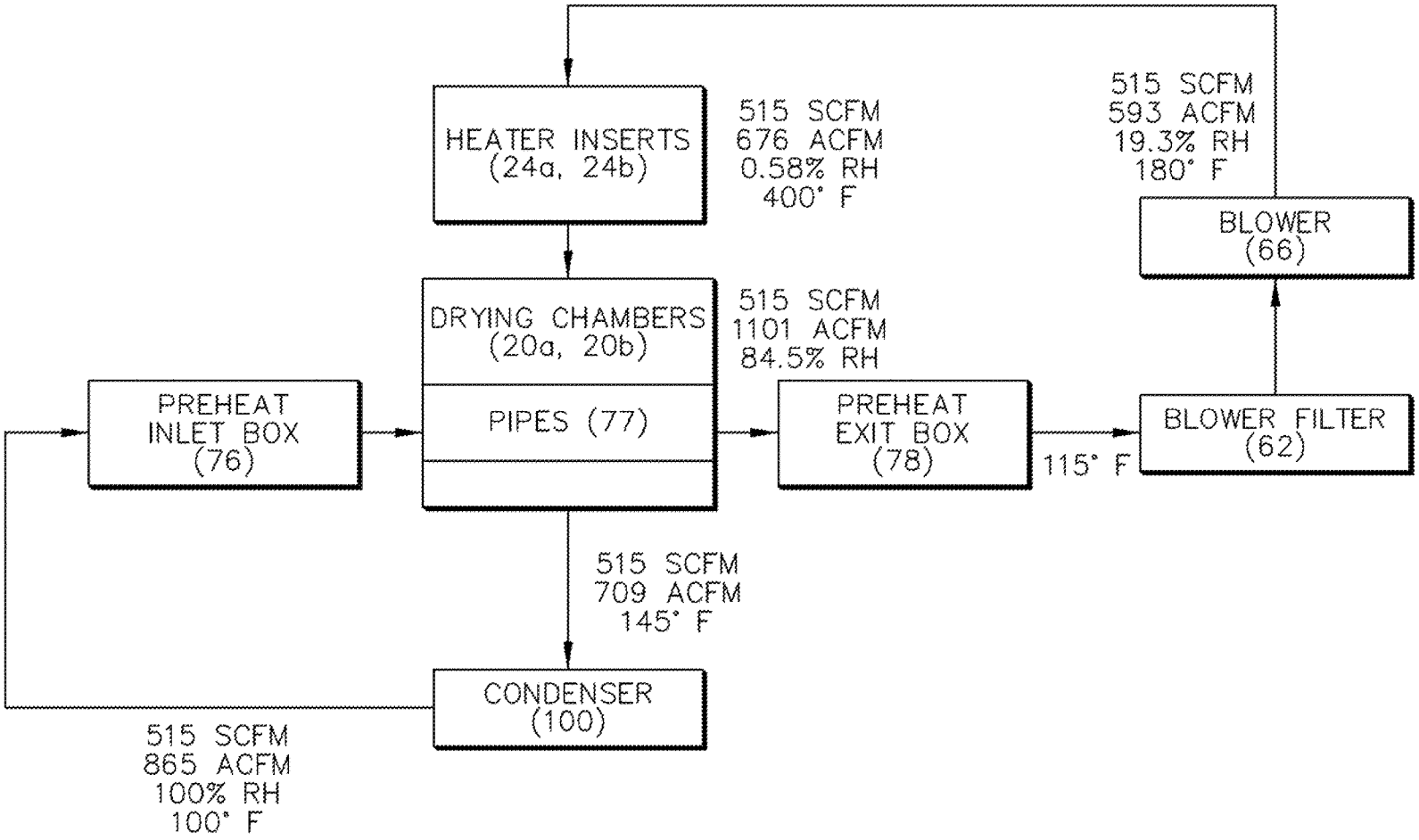
FIG. 4 is a schematic diagram of the air flow through the exemplary apparatus of FIG. 1.

FIG. 4 is a schematic diagram of the air flow through the exemplary apparatus 10. As shown, the blower 66 generates a positive pressure, which injects air into the respective drying chambers 20*a*, 20*b*. The positive pressure generated by the blower 66 acts to increase the temperature of the air, and it also acts to compress and decrease the volume of air that will be subsequently heated. In this regard, the air is directed from the blower 66 through the air injection trunk line 60 to multiple air delivery hoses that, in turn, direct air into the respective drying chambers 20*a*, 20*b*. With respect to the drying chambers 20*a*, 20*b*, the lid 22*a*, 22*b* of each drying chamber 20*a*, 20*b* is provided with one or more heating elements 24*a*, 24*b* that raise the temperature of the air (for example, to approximately 400° F.) as it enters the respective drying chamber 20*a*, 20*b*. In this regard, various forms of heating elements could be used, including heating coils, heat exchangers, or gas burners, to raise the temperature of the air, as further discussed below. Furthermore, although the heating elements 24*a*, 24*b* are incorporated into the lids 22*a*, 22*b* in this exemplary embodiment, the heating elements 24*a*, 24*b* could also be external to the drying chambers 20*a*, 20*b* without departing from the spirit and scope of the present invention.

Referring still to FIG. 4, in one preferred implementation, the blower 66 is operating at approximately 515 standard cubic feet per minute (SCFM). However, as a result of the temperature and pressure conditions, the actual flow rate is approximately 593 actual cubic feet per minute (ACFM) at approximately 5 psi. The pressurized air also results in a higher temperature (for example, 180° F.), with a relative humidity of approximately 19.3%, as the air exits the blower 66 and is delivered to the lids 22*a*, 22*b* of the drying chambers 20*a*, 20*b*. As described above, the one or more heating elements 24*a*, 24*b* in each lid 22*a*, 22*b* then raise the temperature (for example, to approximately 400° F.). As a result, the air expands and is dried, such that the actual flow rate is increased to approximately 676 ACFM, while the relative humidity is reduced to approximately 0.58%.

Referring still to FIG. 4, as mentioned above, air is also pulled through the suspension and out of each drying chamber 20*a*, 20*b*, through one or more vacuum pipe segments 71 positioned below the conveyor belt 30, and into the vacuum pipe 70. In one preferred implementation, a vacuum pressure of approximately 30 inches of water (8 kPa) is created within each drying chamber 20*a*, 20*b*. In this regard, and as will become clearer in the discussion that follows, the air is flowing through the apparatus 10 in a closed loop (i.e., a recirculating air stream), such that the blower 66 is also used to create the vacuum that draws air from each drying chamber 20*a*, 20*b*. Thus, the vacuum pipe 70 is operably connected to the intake of the blower 66.

As a result of the application of the vacuum, the air further expands from its compressed state, through atmospheric conditions, into a negative pressure, such that the actual flow rate is approximately 1101 ACFM as the air passes through the suspension. Such transition of the expanding air occurs in the short distance between the air distribution plate 80 and the conveyor belt 30. In short, the positive-pressure injection of air into the drying chambers 20*a*, 20*b*, combined with the vacuum pressure applied to the drying chambers 20*a*, 20*b*, creates a pressure differential that causes rapid air expansion and acceleration of the air as it passes through the suspension. The expansion and acceleration of the air as it passes through the suspension enables moisture to be removed from the suspension by mass transfer. By heating the air in a dense state (lower volume), the ideal heat transfer by the heating elements 24*a*, 24*b* is also conducted in an efficient manner. Thus, both mass transfer and heat transfer are utilized in an efficient form to remove liquid from the suspension. Accordingly, as the air passes through the suspension, the air becomes heavily saturated, and the relative humidity increases to approximately 84.5% (or higher).

Figure 2:
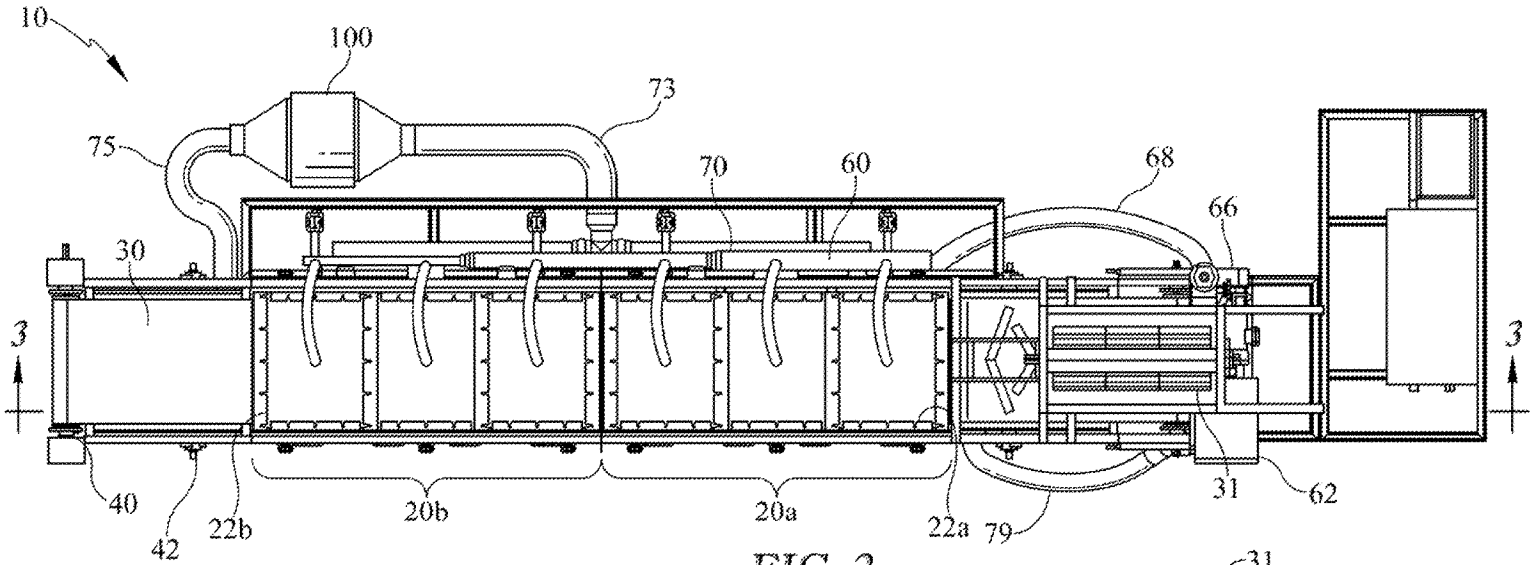
FIG. 2 is a top view of the exemplary apparatus of FIG. 1, with the lids of the drying chambers in a closed position.

Referring now to FIGS. 2 and 4, the heavily saturated air is then evacuated from the respective drying chambers 20*a*, 20*b* and delivered via a hose 73 to a condenser assembly 100. As the air leaves the drying chambers 20*a*, 20*b*, it has cooled, such that, in one preferred implementation, the actual flow rate is reduced to 709 ACFM, and the temperature of the air is approximately 145° F. as it enters the condenser assembly 100. As further discussed below, the condenser assembly 100 is designed to have a larger total volume (i.e., larger total diameter), such that the saturated air reduces its speed while in contact with the chilled surfaces of the condenser assembly 100. Thus, in the condenser assembly 100, the air reaches full saturation (100% relative humidity), and the liquid component (such as water) is drawn from the air as it cools. Cooled air then exits the condenser with 100% relative humidity, but at a lower temperature (for example, 100° F.) under the vacuum pressure.

Referring still to FIGS. 2 and 4, the cooled air flows from the condenser assembly 100, through a hose 75, and then back through the drying chambers 20*a*, 20*b* via a series of pipes 77 beginning at a preheat inlet box 76 and ending at a preheat exit box 78. The air is passed through the drying chambers 20*a*, 20*b* in this manner to preheat and increase the temperature of the air. Such a preheating arrangement thus enables the use of heat that was not absorbed by the suspension to aid in the drying process. In one preferred implementation, as the air exits the preheat exit box 78 after completing its travel through the drying chambers 20*a*, 20*b*, it has reached a temperature of approximately 115° F.

Referring still to FIGS. 2 and 4, after exiting through the preheat exit box 78, the air flows through a return hose 79 to a blower filter box 62 that provides filtration of the air prior to returning it to the blower 66. The blower filter box 62 prevents any foreign materials, grease, or particulates from reaching the blower 66 where it could cause maintenance problems or damage. In one preferred implementation, as the air exits the blower filter box 62 and enters the blower 66, the actual flow rate is approximately 802 ACFM, and the relative humidity is approximately 64.0%. Of course, the blower 66 again compresses and raises the temperature of the air, so that, in one preferred implementation, it again exits the blower 66 with an actual volumetric flow rate of approximately 593 ACFM at a temperature of approximately 180° F. and a relative humidity of approximately 19.3%. The air is then again directed through the air injection trunk line 60, through the multiple air delivery hoses, heated by the heating elements 24*a*, 24*b*, and then injected into the respective drying chambers 20*a*, 20*b*.

Again, as described above, the air is flowing through the apparatus 10 in a closed loop (i.e., a recirculating air stream), such that the blower 66 is also used to create the vacuum that draws air from each drying chamber 20*a*, 20*b*. As a result, no exhausting of the air stream is necessary, which often requires some form of costly permitting. Furthermore, as described above, thermal energy is not wasted as the preheating arrangement enables the use of heat that was not absorbed by the suspension to aid in the drying process.

Although not shown in the Figures, it is, of course, contemplated that an apparatus for removing liquid from a suspension made in accordance with the present invention would include a control system. For example, with respect to the exemplary apparatus 10 described above, such a control system could include a microprocessor with a memory component. A motor associated with the conveyor belt 30 would be operably connected to and receive control signals from the microprocessor. Similarly, the blower 66 would be operably connected to and receive control signals from the microprocessor. The heating elements 24*a*, 24*b*, the material sifter 31, and the condenser assembly 100 also would be operably connected to and receive control signals from the microprocessor. Accordingly, each of these components could be operated in response to user input. Furthermore, preprogrammed routines could be stored in the memory component to automate the process. For example, the user may simply have to press a button to activate a preprogrammed routine that operates the components to initiate and carry out a drying process for a particular suspension.

As described above, the condenser assembly 100 included in an apparatus for removing liquid from a suspension has heavily saturated air delivered to the condenser assembly 100 from the drying chambers 20*a*, 20*b*. In the condenser assembly 100, the liquid component (such as water) is drawn from the air as it cools and is collected in a water collection box associated with the condenser assembly 100.

Figure 5:
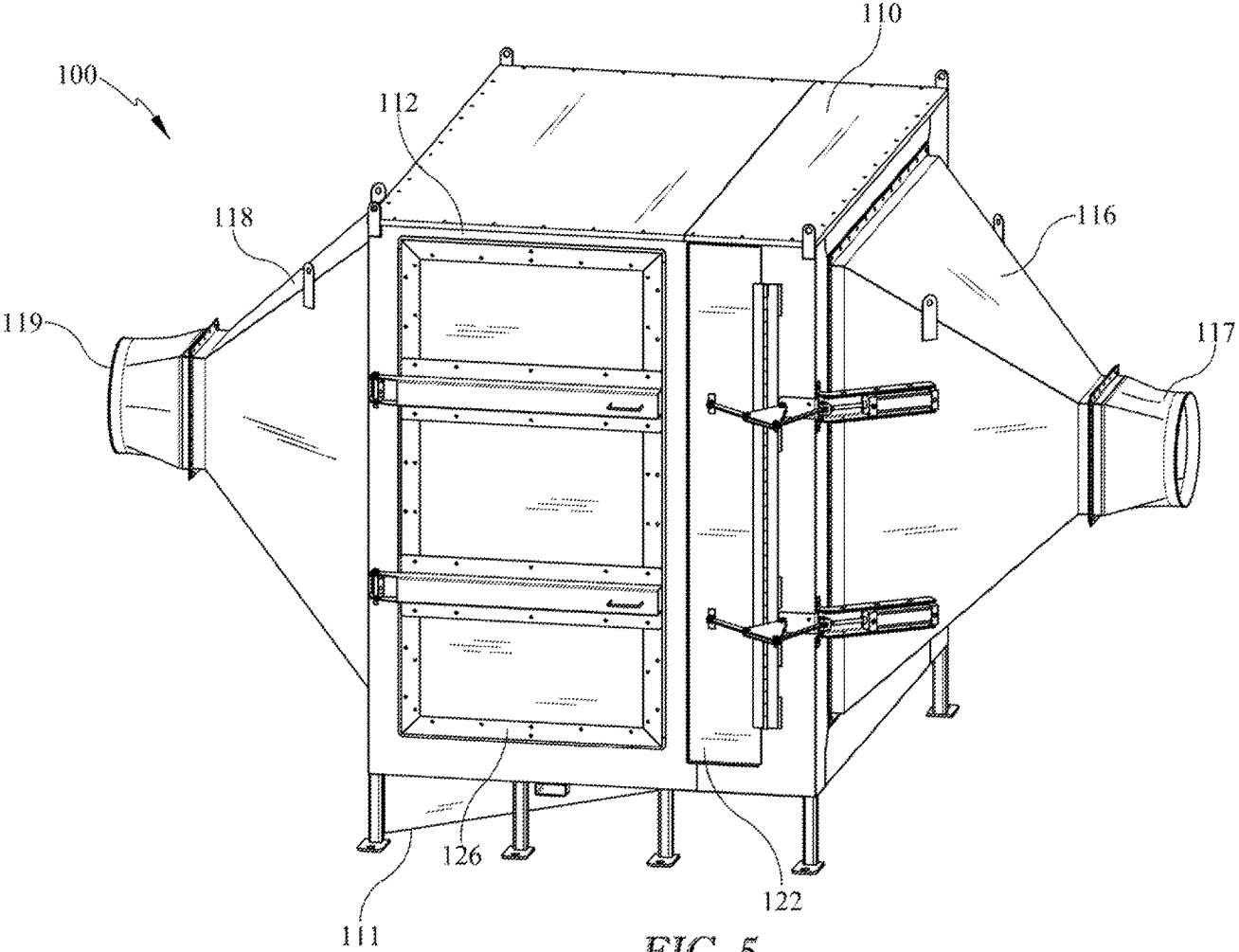
FIG. 5 is a perspective view of the exemplary condenser assembly used in the apparatus of FIG. 1.
Figure 6:
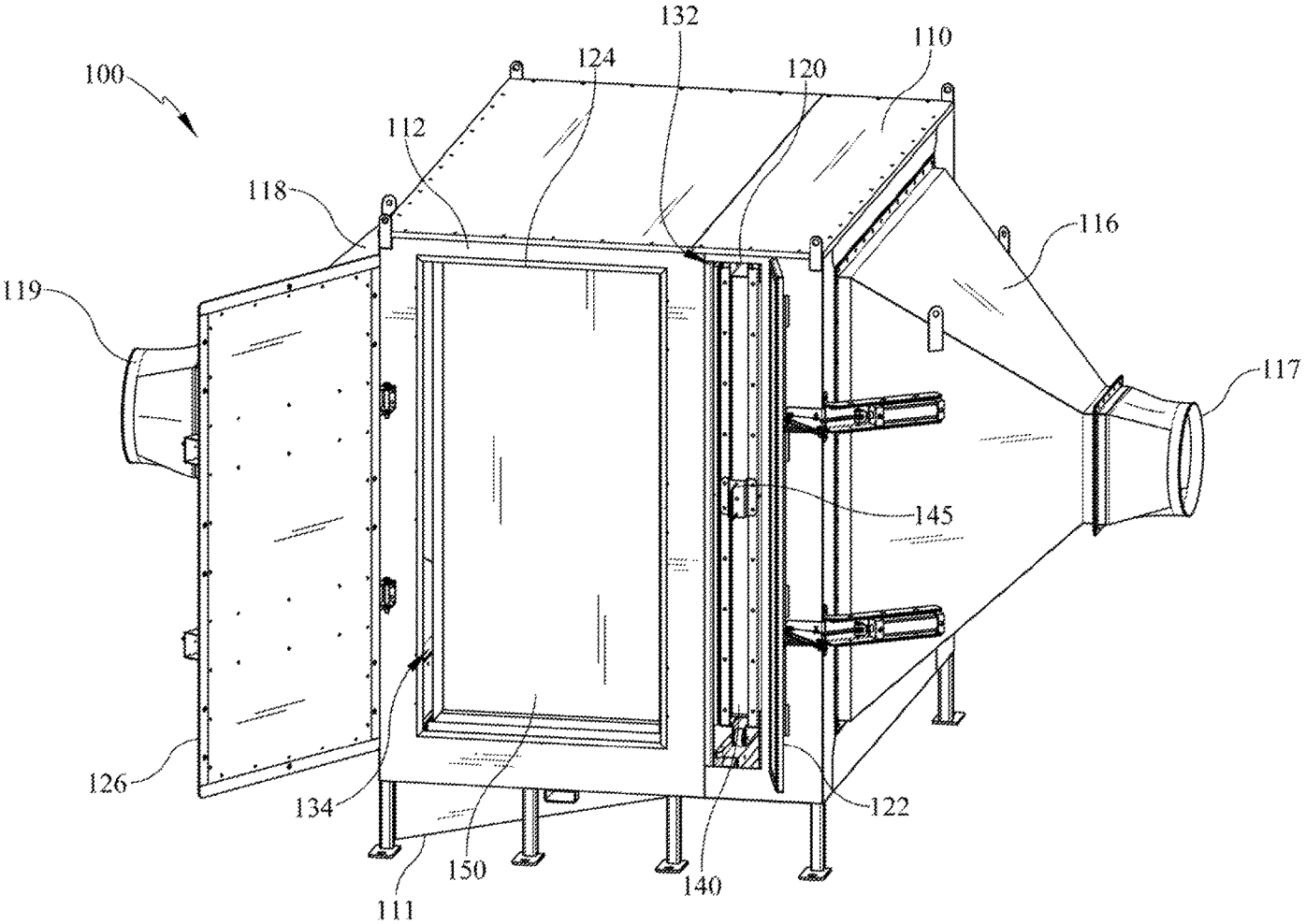
FIG. 6 is a perspective view of the exemplary condenser assembly similar to FIG. 5, but with the first door and the second door open to expose a filter frame and condenser box, each of which is in a first position within the main cabinet of the condenser assembly.

Referring now to FIGS. 5 and 6, an exemplary condenser assembly 100 for use with an apparatus for removing liquid from a suspension and made in accordance with the present invention generally comprises: a main cabinet 110; a filter frame 140 and associated filters 142 (FIG. 9) that are moveable between a first (operating) position within the main cabinet 110 and a second (maintenance) position substantially outside of the main cabinet 110; and a condenser box 150 that is similarly moveable between a first (operating) position within the main cabinet 110 and a second (maintenance) position substantially outside of the main cabinet 110.

The condenser assembly 100 further includes an inlet 117 and an outlet 119 which are operably connected to the respective hoses 73, 75 described above with respect to FIGS. 2 and 4. As discussed above, the condenser assembly 100 is designed to have a larger total volume (i.e., larger total diameter) than the remainder of the closed loop of the apparatus 10, such that the saturated air entering the condenser assembly 100 reduces its speed while in contact with the chilled surfaces of the condenser assembly 100. To this end, a tapered inlet wall 116 extends between and connects the inlet 117 to the main cabinet 110, and similarly, a tapered outlet wall 118 extends between and connects the outlet 119 to the main cabinet 110.

Referring still to FIGS. 5 and 6, the main cabinet 110 includes a front wall 112 which defines a first opening 120 associated with the filter frame 140 and a second opening 124 associated with the condenser box 150. The main cabinet 110 defines a first interior cavity 132 that is accessible via the first opening 120, which receives and houses the filter frame 140 and associated filters 142 in the first position. Similarly, the main cabinet 110 also defines a second interior cavity 134 that is accessible via the second opening 124, which receives and houses the condenser box 150 in the first position, as further discussed below.

As also shown in FIGS. 5 and 6, a first door 122 selectively closes the first opening 120, and a second door 126 selectively closes the second opening 124. In the exemplary embodiment shown in FIGS. 5 and 6, the first door 122 is operated by a set of actuators, whereas the second door 126 is operated by a handle, but it is understood that either of the doors 122, 126 can be operated by handles, actuators, or any other number of mechanisms known in the art. Furthermore, as shown in FIG. 6 in particular, it is preferred that the first door 122 and the second door 126 each have a gasket or similar sealing means around its periphery to seal each door 122, 126 relative to the main cabinet 110 when closed. Furthermore, it is contemplated that the second door 126 is preferably transparent and allows for a view into the second interior cavity 134, and thus the condenser box 150, even when the second door 126 is closed.

Figure 7:
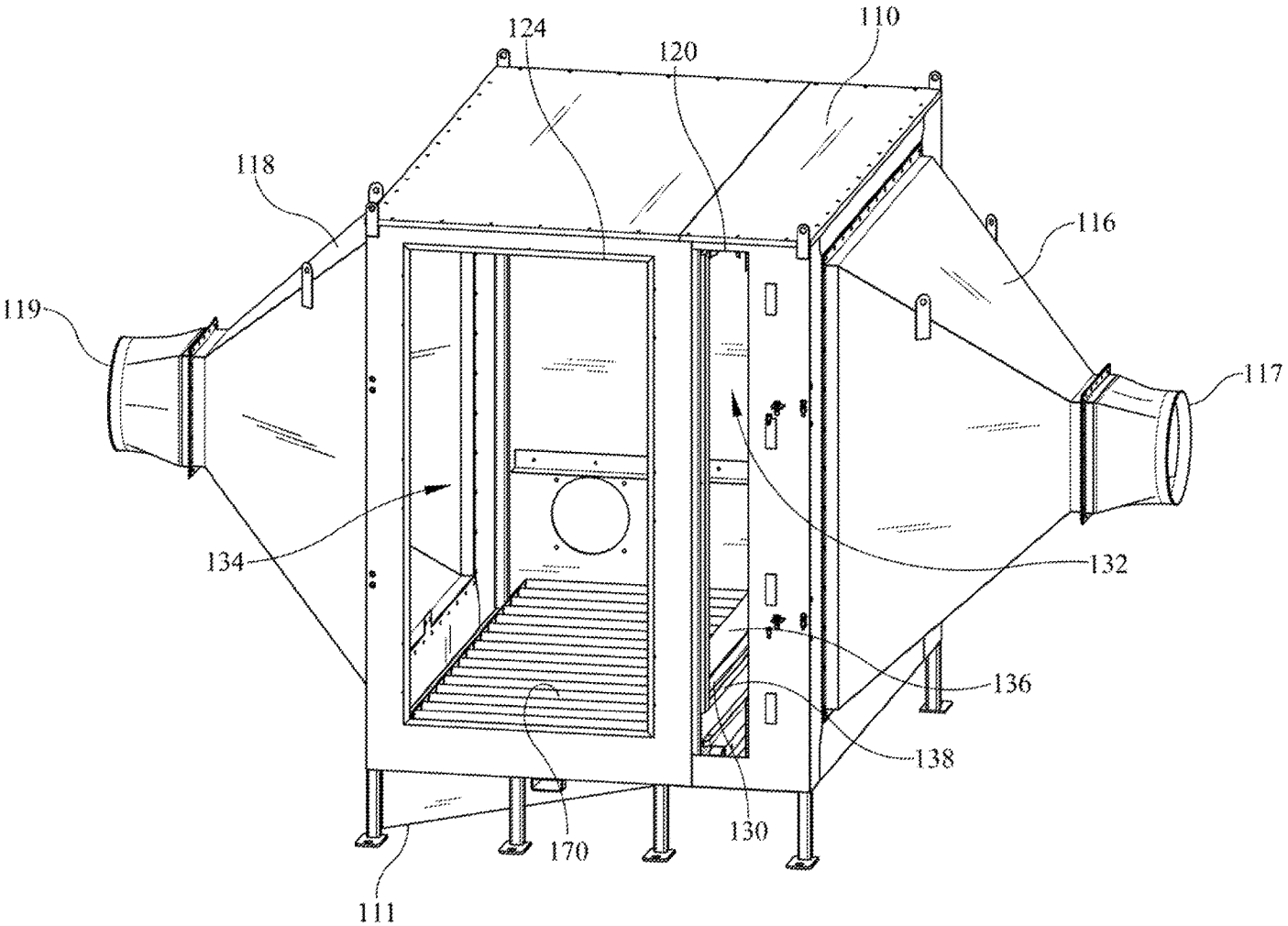
FIG. 7 is a perspective view of the exemplary condenser assembly similar to FIG. 5, but with the first door and the second door removed to show the first and second interior cavities of the main cabinet.

Referring now to FIG. 7, an intermediate panel 130 is positioned within the main cabinet 110 between the first interior cavity 132 and the second interior cavity 134, with the intermediate panel 130 defining a passageway 136 between the first interior cavity 132 and the second interior cavity 134. Furthermore, a gasket 138 is positioned on the intermediate panel 130 around the passageway 136 and within the first interior cavity 132. The gasket 138 is therefore positioned so as to seal the filter frame 140 relative to the intermediate panel 130 when the filter frame 140 is in the first position. As such, in operation, all of the air entering the condenser assembly 100 passes through the filters 142 of the filter frame 140 before entering the second interior cavity 134 and contacting the condenser box 150.

Figure 8:
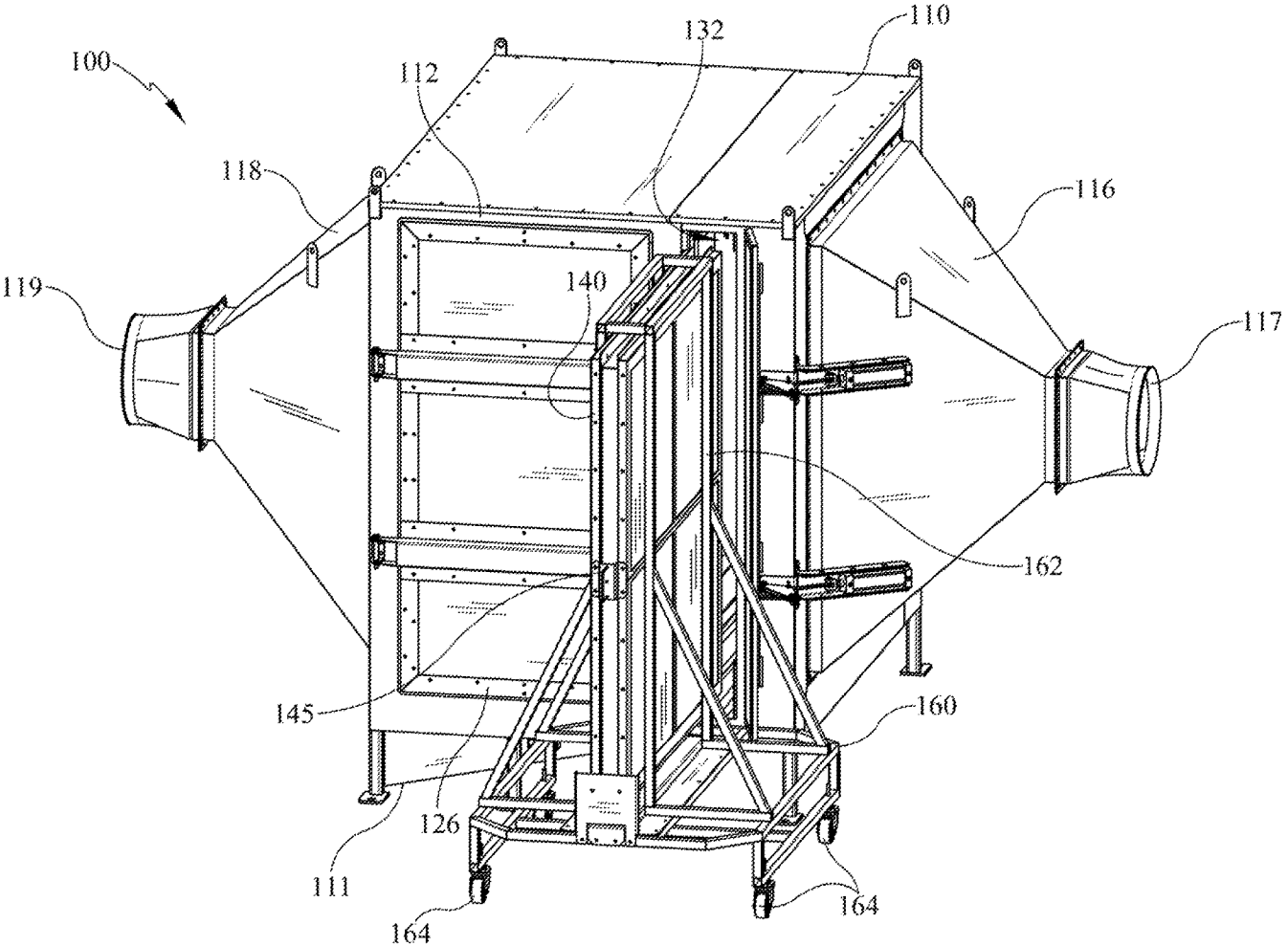
FIG. 8 is a perspective view of the exemplary condenser assembly similar to FIG. 5, but with the filter frame and associated filters in a second position outside of the main cabinet of the condenser assembly and on a filter roller cart.

Referring now to FIG. 8, the filter frame 140 and associated filters 142 can readily be withdrawn from the main cabinet 110 of the condenser assembly 100 through the first opening 120 in the front wall 112 of the main cabinet 110. In the exemplary embodiment shown in FIG. 8, a filter roller cart 160 is positioned outside of the main cabinet 110 adjacent to the first opening 120. The filter roller cart 160 includes a vertical support structure 162 which is sized and configured to accept and maintain the filter frame 140 in an upright position when outside of the main cabinet 110. The vertical support structure 162 of the filter roller cart 160 is supported on multiple casters 164 that engage the underlying ground surface. The filter roller cart 160 with the filter frame 140 supported thereon can thus be readily moved to another location. For instance, it may be desirable to move the filter frame 140 and associated filters 142 to clean and/or replace one or more filters 142.

Figure 9:
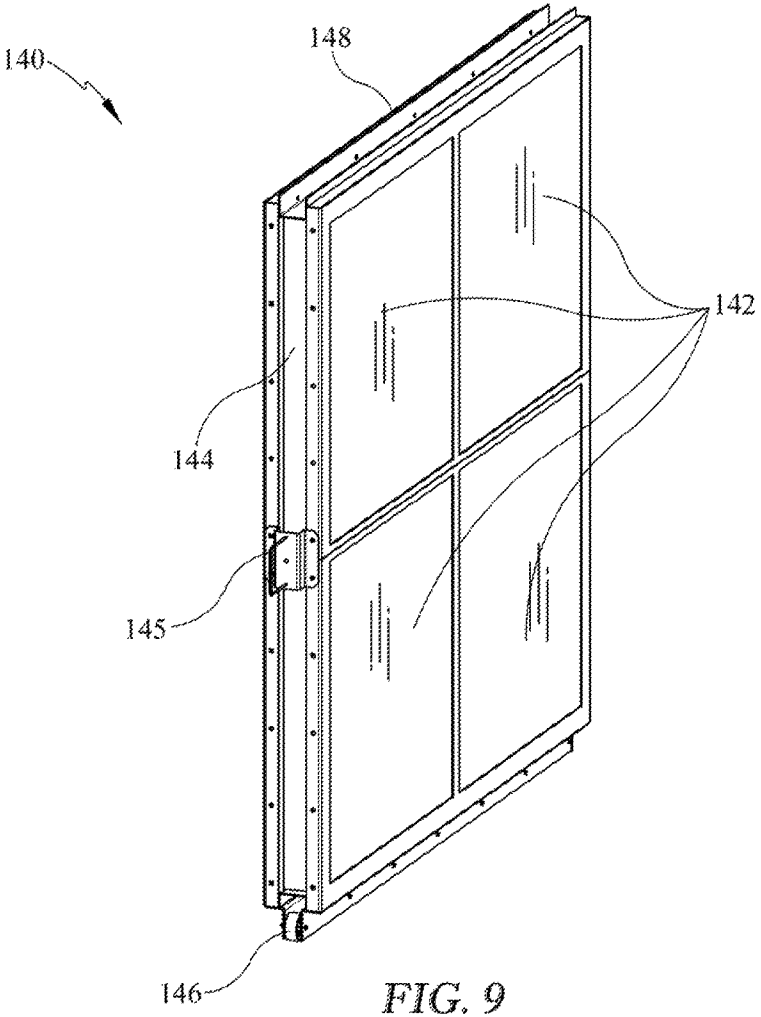
FIG. 9 is a perspective view of the filter frame and associated filters shown in isolation.

Referring now to FIGS. 8 and 9, in this exemplary embodiment, the filter frame 140 forms a grid upon which the filters 142 are mounted or otherwise received. The filter frame 140 includes a plurality of wheels 146 (only a front wheel 146 is shown in FIG. 9) located at the bottom of the filter frame 140, along with a guide plate 148 located at the top of the filter frame 140, as further discussed below. A front panel 144 of the filter frame 140 also includes a handle 145, as further discussed below.

Figure 10A:
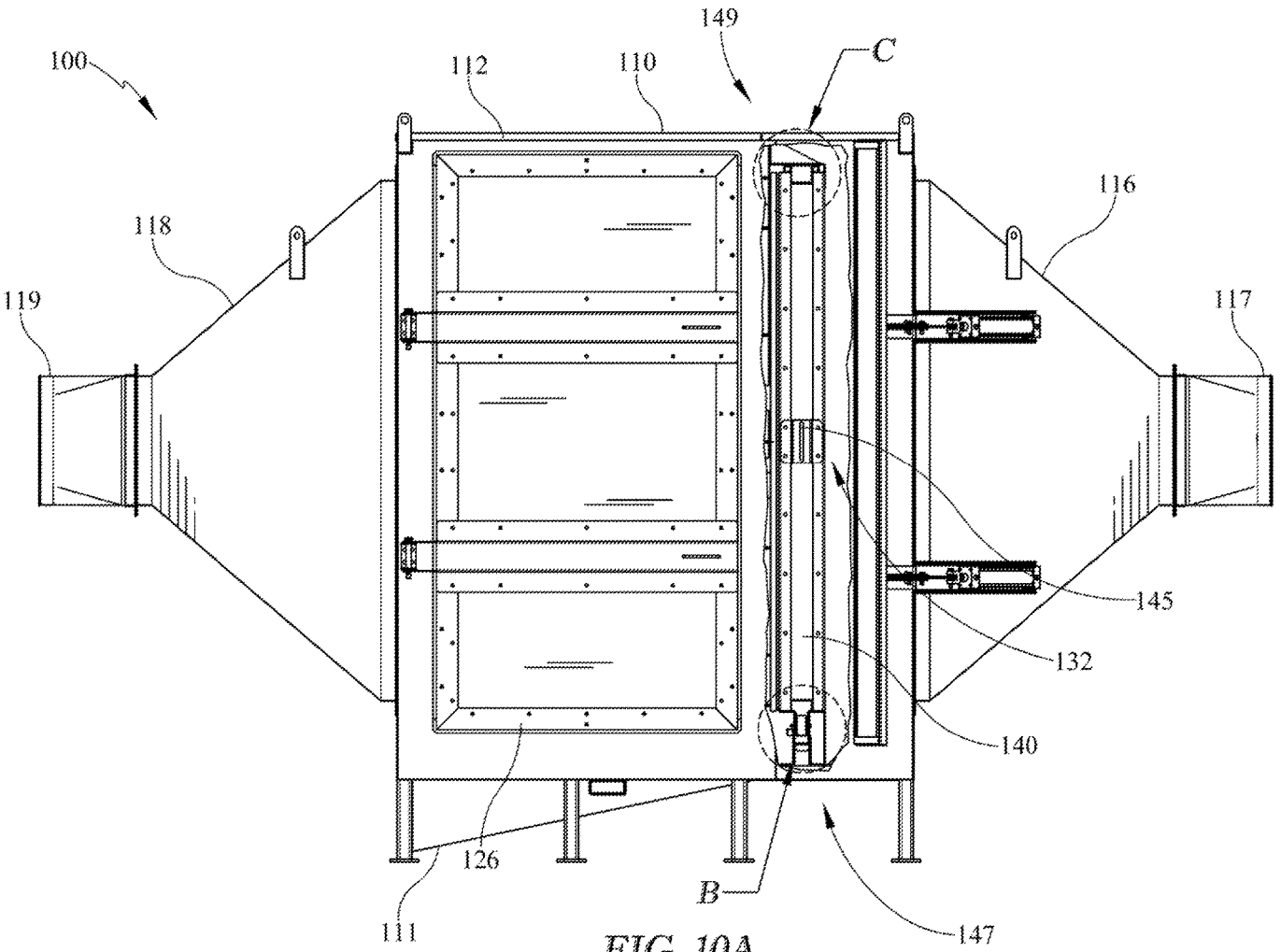
FIG. 10A is a partial sectional view of the condenser assembly of FIG. 5, showing the filter frame in the first position within the main cabinet of the condenser assembly.
Figure 10B:
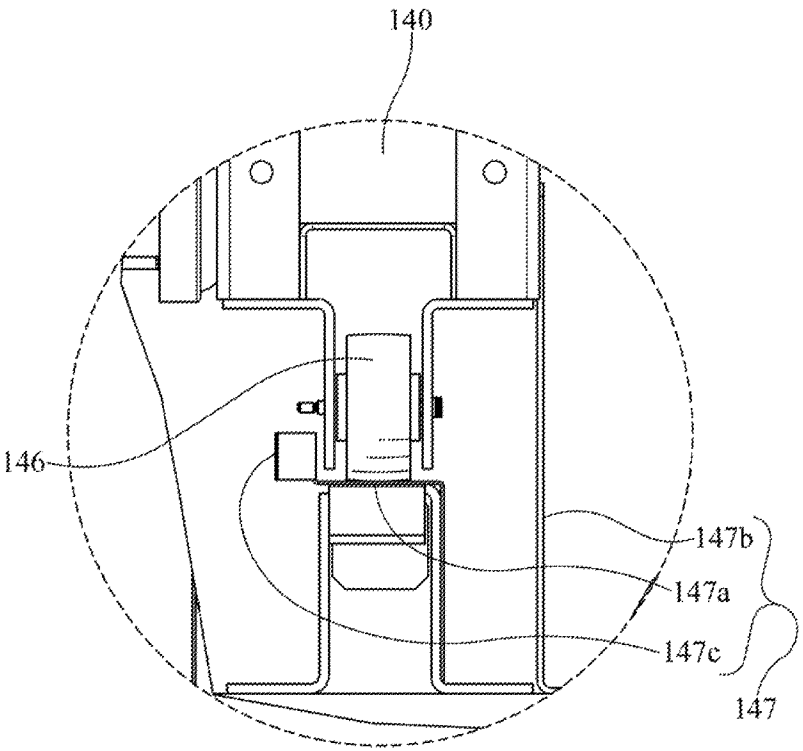
FIG. 10B is an enlarged, detailed view of a portion of the condenser assembly of FIG. 10A.
Figure 10C:
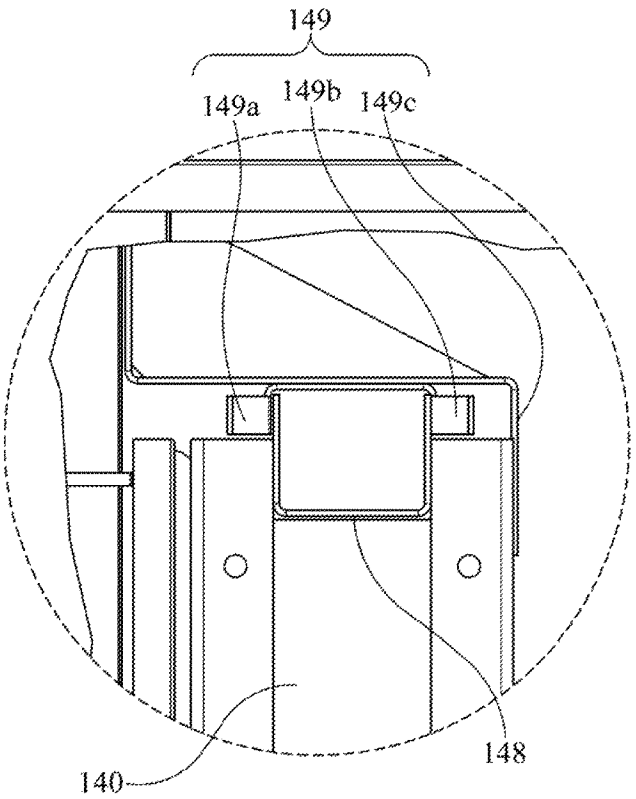
FIG. 10C is an enlarged, detailed view of a portion of the condenser assembly of FIG. 10A.

Referring now to FIGS. 10A-10C, when the filter frame 140 is in the first position within the first interior cavity 132 of the main cabinet 110, the plurality of wheels 146 of the filter frame 140 engage a lower filter guide track 147 located within the first interior cavity 132, and the guide plate 148 engages an upper filter guide track 149 located within the first interior cavity 132. In particular, as shown in FIG. 10B, in this exemplary embodiment, the lower filter guide track 147 includes a horizontal plate 147*a* which supports the plurality of wheels 146 of the filter frame 140, along with two vertical plates 147*b*, 147*c* which engage and prevent lateral movement of the filter frame 140. As shown in FIG. 10C, the upper filter guide track 149 includes a plurality of vertical plates 149*a*, 149*b*, 149*c*, with the first and second vertical plates 149*a*, 149*b* engaging the guide plate 148 (which is in the form of a channel) and the third vertical plate 149*c* engaging the side of the filter frame 140. The plurality of vertical plates 149*a*, 149*b*, 149*c* of the upper filter guide track 149 therefore also prevent the lateral movement of the filter frame 140. In this way, the lower filter guide track 147 and the upper filter guide track 149 collectively act to ensure the filter frame 140 is appropriately positioned when in operation.

Figure 11:
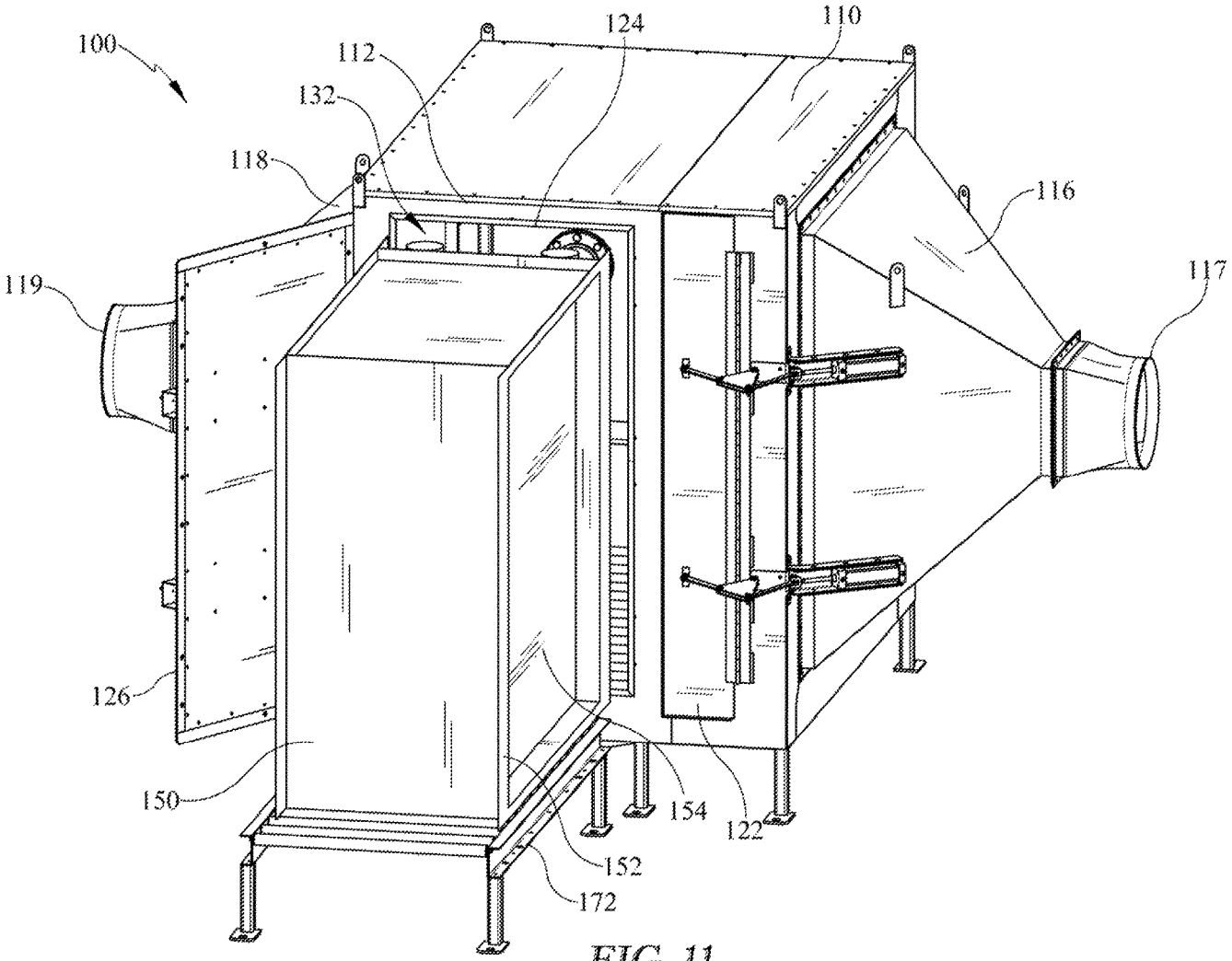
FIG. 11 is a perspective view of the exemplary condenser assembly similar to FIG. 5, but with the condenser box in a second position outside of the main cabinet of the condenser assembly and on an exterior roller conveyor.
Figure 12:
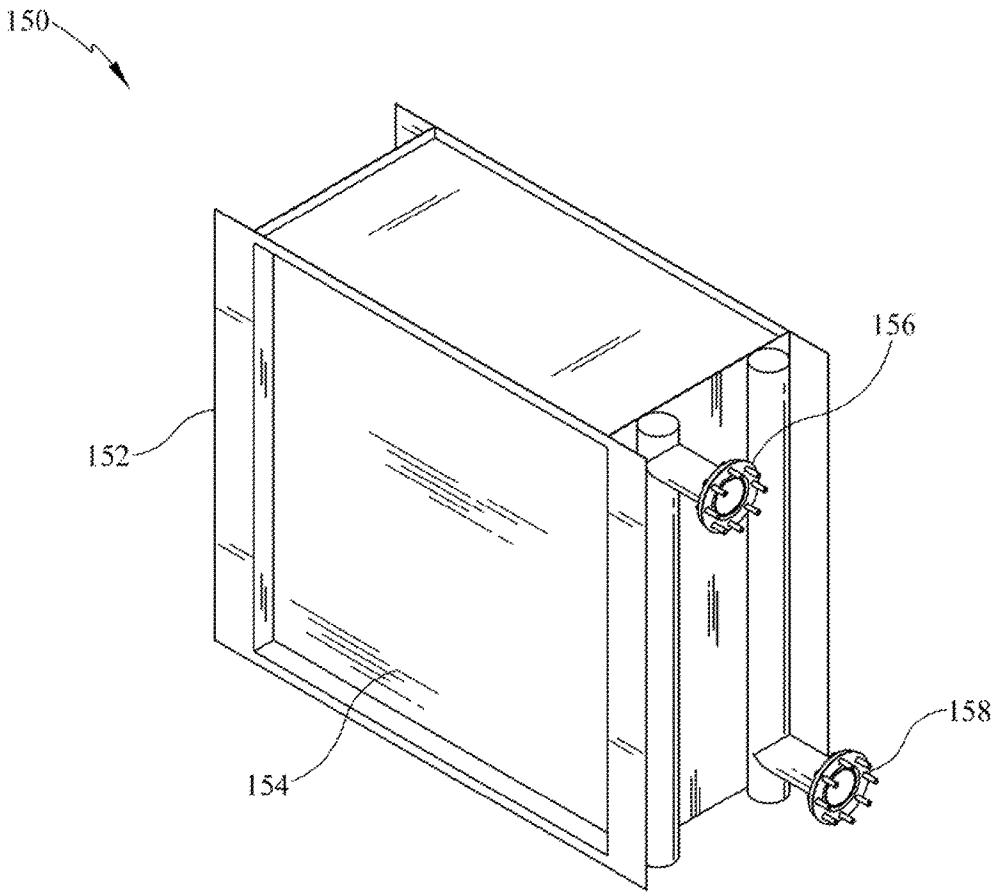
FIG. 12 is a rear perspective view of the condenser box of the exemplary condenser assembly shown in isolation.
Figure 13:
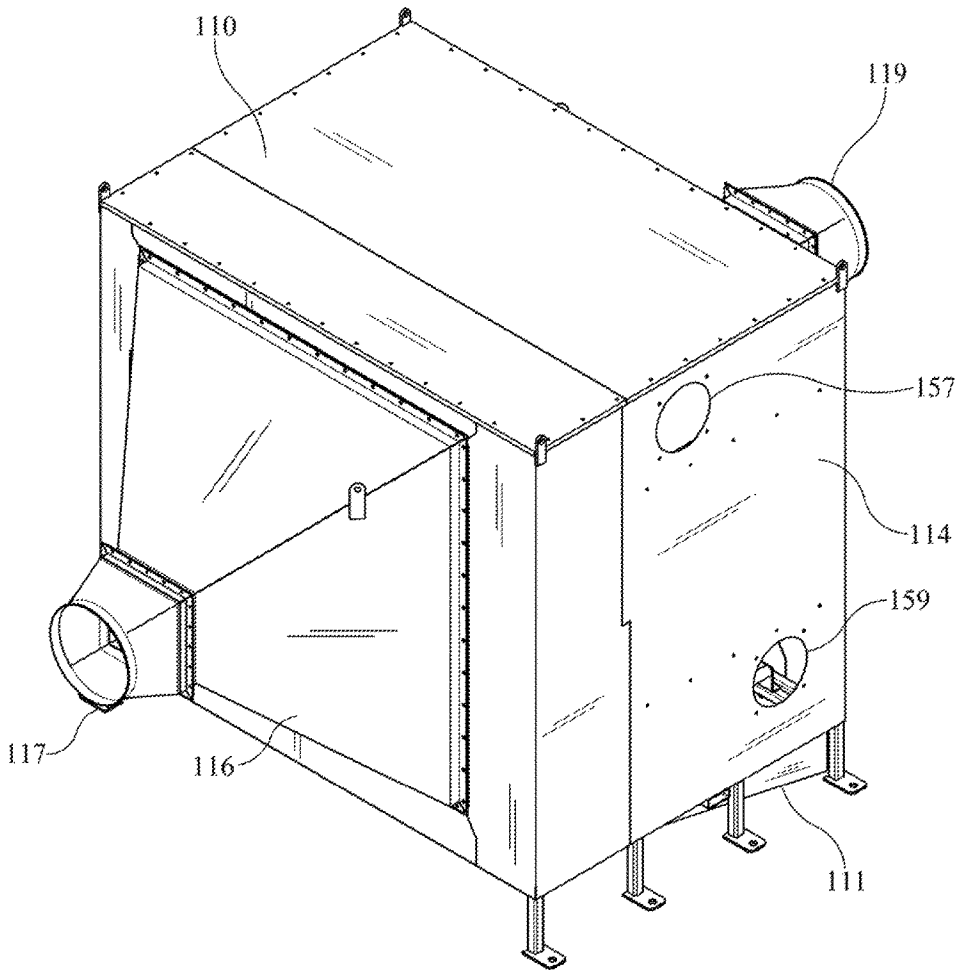
FIG. 13 is a rear perspective view of the main cabinet of the exemplary condenser assembly shown in isolation.

Referring now to FIGS. 6, 8, and 10A-10C, the filter frame 140 is readily moved between the first position and the second position. More specifically, when the filter frame 140 is in the first (operating) position within the first interior cavity 132 of the main cabinet 110 (FIG. 6), the plurality of wheels 146 are positioned on and supported by the horizontal plate 147*a* of the lower filter guide track 147. By opening the door 122 that selectively closes the first opening 120, and pulling on the handle 145 that is mounted to the front panel 144 of the filter frame 140, a user can move the filter frame 140 and associated filters 142 from the first position within the first interior cavity 132 of the main cabinet 110 to the second (maintenance) position outside of the main cabinet 110 (FIG. 8), with the plurality of wheels 146 facilitating such movement. Similarly, the filter frame 140 can be returned to the first position by first positioning the filter roller cart 160 with the filter frame 140 adjacent to the first opening 120. The filter frame 140 is then pushed off of the filter roller cart 160 and into the first interior cavity 132, with the lower and upper filter guide tracks 147, 149 guiding the filter frame 140 into the first position. Referring now to FIGS. 11-13, similar to the filter frame 140, the condenser box 150 can also readily be withdrawn from the main cabinet 110 of the condenser assembly 100 through the second opening 124 defined through the front wall 112 of the main cabinet 110. As shown in FIGS. 11 and 12, the condenser box 150 includes a frame 152 and all of the coils and piping (generally represented in the Figures as box 154) necessary for the condensing function and the removal of the liquid component (water) from the saturated air as it cools. Furthermore, as perhaps best shown in FIG. 12, the condenser box 150 includes an inlet 156 and outlet 158 which allow for circulation of refrigerant through the coils and piping 154 of the condenser box 150. To this end, as shown in FIG. 13, a rear wall 114 of the main cabinet 110 defines two holes 157, 159 which, when the condenser box 150 is in the first position, are aligned with the inlet 156 and outlet 158 of the condenser box 150.

Referring now to FIGS. 7 and 11, as previously mentioned, the main cabinet 110 defines a second interior cavity 134 that is accessible via the second opening 124, which receives and houses the condenser box 150 in the first position. As shown in FIG. 7, an inner roller conveyer 170 is positioned within the second interior cavity 134 of the main cabinet 110, which supports the condenser box 150 in the first position. As shown in FIG. 11, the exemplary condenser assembly 100 further includes an exterior roller conveyor 172 which extends from the second opening 124 and is positioned outside of the main cabinet 110. The exterior roller conveyor 172 supports the condenser box 150 in the second position and is supported on multiple legs that engage the underlying ground surface. Thus, by opening the door 126 that selectively closes the second opening 124, the condenser box 150 can be withdrawn from the main cabinet 110 of the condenser assembly 100, from the first (operating) position to the second (maintenance) position, over the respective first and second roller conveyors 170, 172. For instance, it may be desirable to move the condenser box 150 to the second position to maintain and/or repair the condenser box 150 or components thereof.

Of course, as the liquid component (water) is removed from the saturated air, the condensate falls under the force of gravity to the bottom of the main cabinet 110. Thus, the main cabinet 110 preferably includes a bottom panel 111 which is sloped to direct the condensate toward an outlet (not shown). Furthermore, although not shown in the Figures, the condenser assembly 100 may be equipped with a pumping system that is automatically activated for removal of the condensate, for example, when the condensate level reaches a certain threshold.

Figure 14:
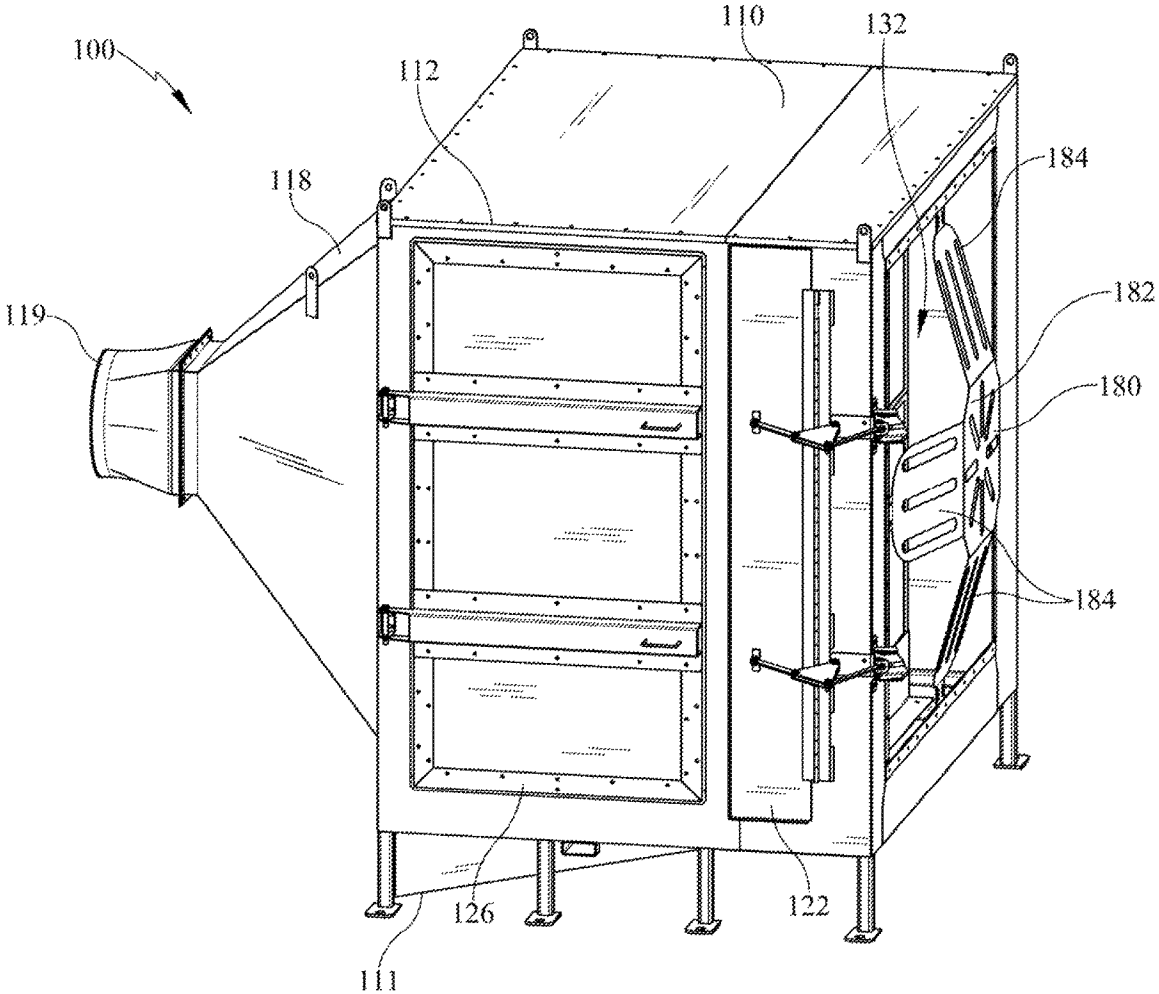
FIG. 14 is a perspective view of the exemplary condenser assembly similar to FIG. 5, but with the tapered inlet wall and first door actuators removed to show the diffuser.

Referring now to FIG. 14, in the exemplary condenser assembly 100, the main cabinet 110 also include a diffuser 180 that diffuses the saturated air as it enters the condenser assembly 100 and before it contacts the filters 142. More specifically, in this exemplary embodiment, the diffuser includes a central member 182 and four (three shown) radially extending lateral members 184 which are each perforated to disturb the flow of saturated air as it enters the condenser assembly 100.

As a further refinement, although not shown in the Figures, it is also contemplated that the condenser assembly 100 could include a secondary filter box at or near the inlet 117 for dust and debris collection before saturated air enters the main cabinet 110. It is contemplated that such a secondary filter box could be positioned upstream or downstream of the diffuser 180 shown in FIG. 14.

Figure 3:
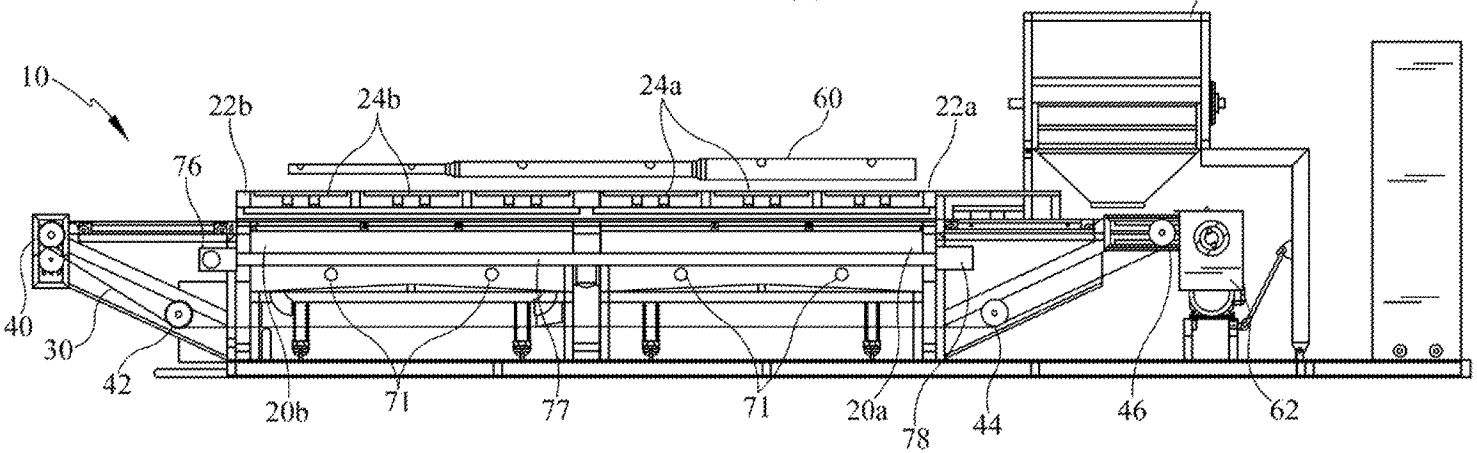
FIG. 3 is a side sectional view of the exemplary apparatus of FIG. 1 taken along line 3-3 of FIG. 2.

Although not shown in the Figures, as a further refinement, the condenser assembly 100 could also function as a heat exchanger, with heat absorbed from the saturated air passing through the condenser box 150 being used, for example, in combination with or in place of the heating elements 24*a*, 24*b* described with respect to FIGS. 3 and 4 above in an apparatus for removing liquid from a suspension.

Although not shown in the Figures, as a further refinement, a wash system could be incorporated into the condenser box 150 to clean the filters 142, condenser coils, and/or other components.

Finally, as mentioned above, although the condenser assembly of the present invention is particularly useful as part of an apparatus for removing liquid from a suspension, the condenser assembly of the present invention may also be used in other applications for removing a liquid component, such as water, from an air stream, especially when it would be beneficial to provide ready access to the filters and/or condenser box for maintenance.

One of ordinary skill in the art will also recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the present invention.

What is claimed is:

1. A condenser assembly, comprising:

a main cabinet;

one or more filters mounted to a filter frame that is moveable between a first position within the main cabinet and a second position substantially outside of the main cabinet; and a condenser box that is moveable between a first position within the main cabinet and a second position substantially outside of the main cabinet;

wherein, when the filter frame is in the first position, the filter frame is positioned within a first interior cavity defined by the main cabinet, and when the condenser box is in the first position, the condenser box is positioned within a second interior cavity defined by the main cabinet; and wherein the filter frame includes a plurality of wheels, and the main cabinet includes a lower filter guide track located within the first interior cavity of the main cabinet and configured to engage the plurality of wheels on the filter frame, thus facilitating movement of the filter frame between the first position and the second position.

2. The condenser assembly as recited in claim 1, and further comprising an upper filter guide track located within the first interior cavity of the main cabinet and configured to engage a guide plate of the filter frame.

3. A condenser assembly, comprising:

a main cabinet;

one or more filters mounted to a filter frame that is moveable between a first position within the main cabinet and a second position substantially outside of the main cabinet;

a condenser box that is moveable between a first position within the main cabinet and a second position substantially outside of the main cabinet; and a filter roller cart positioned outside of the main cabinet and adjacent to an opening defined through a wall of the main cabinet to support the filter frame in the second position;

wherein, when the filter frame is in the first position, the filter frame is positioned within a first interior cavity defined by the main cabinet, and when the condenser box is in the first position, the condenser box is positioned within a second interior cavity defined by the main cabinet.

4. A condenser assembly, comprising:

a main cabinet;

one or more filters mounted to a filter frame that is moveable between a first position within the main cabinet and a second position substantially outside of the main cabinet;

a condenser box that is moveable between a first position within the main cabinet and a second position substantially outside of the main cabinet; and a first roller conveyor positioned within the second interior cavity of the main cabinet to support the condenser box in the first position;

wherein, when the filter frame is in the first position, the filter frame is positioned within a first interior cavity defined by the main cabinet, and when the condenser box is in the first position, the condenser box is positioned within a second interior cavity defined by the main cabinet.

5. The condenser assembly as recited in claim 4, and further comprising a second roller conveyor positioned outside of the main cabinet and adjacent an opening defined through a wall of the main cabinet to support the condenser box in the second position.

6. The condenser assembly as recited in claim 1, and further comprising an intermediate panel positioned within the main cabinet and defining a passageway between the first interior cavity and the second interior cavity.

7. The condenser assembly as recited in claim 6, and further comprising a gasket positioned around the passageway of the intermediate panel and within the first interior cavity, the gasket configured to seal the filter frame relative to the intermediate panel when the filter frame is in the first position.

8. The condenser assembly as recited in claim 1, and further comprising a diffuser that diffuses a flow of air as it enters the condenser assembly and before it contacts the one or more filters.

9. A condenser assembly, comprising:

a main cabinet having a front wall, the main cabinet defining a first interior cavity accessible via a first opening defined in the front wall and a second interior cavity accessible via a second opening defined in the front wall;

one or more filters mounted to a filter frame that is moveable between a first position within the first interior cavity of the main cabinet and a second position substantially outside of the main cabinet;

a condenser box that is moveable between a first position within the second interior cavity of the main cabinet and a second position substantially outside of the main cabinet; and a filter roller cart positioned outside of the main cabinet and adjacent to an opening defined through a wall of the main cabinet to support the filter frame in the second position.

10. The condenser assembly as recited in claim 9, and further comprising a first roller conveyor positioned within the second interior cavity of the main cabinet to support the condenser box in the first position.

11. The condenser assembly as recited in claim 10, and further comprising a second roller conveyor positioned outside of the main cabinet and adjacent an opening defined through a wall of the main cabinet to support the condenser box in the second position.

12. An apparatus for removing liquid from a suspension, comprising:

one or more drying chambers;

a conveyor system transporting the suspension through the one or more drying chambers, including a semi-permeable conveyor belt;

a blower injecting compressed air into the one or more drying chambers;

a vacuum means drawing saturated air out of each of the one or more drying chambers, thus creating a pressure differential that causes rapid expansion and acceleration of the air as it passes through the suspension in the one or more drying chambers; and a condenser assembly receiving the saturated air from the vacuum means, cooling the saturated air, and collecting liquid from the saturated air, the condenser assembly including a main cabinet, one or more filters mounted to a filter frame that is moveable between a first position within the main cabinet and a second position substantially outside of the main cabinet, and a condenser box that is moveable between a first position within the main cabinet and a second position substantially outside of the main cabinet.

13. The apparatus for removing liquid from a suspension as recited in claim 12, wherein the vacuum means comprises a vacuum pipe that runs along the length of the one or more drying chambers, along with one or more vacuum pipe segments that extend from the vacuum pipe into the bottom of each of the one or more drying chambers drawing the saturated air out of each of the one or more drying chambers, and directing it via the vacuum pipe to the condenser assembly.

14. The apparatus for removing liquid from a suspension as recited in claim 13, wherein the vacuum pipe is operably connected to an intake of the blower.

15. The apparatus for removing liquid from a suspension as recited in claim 13, and further comprising a preheating arrangement in which cooled air exiting the condenser assembly is passed through the one or more drying chambers to preheat and increase the temperature of the cooled air before returning it to the blower.

16. The condenser assembly as recited in claim 3, and further comprising a diffuser that diffuses a flow of air as it enters the condenser assembly and before it contacts the one or more filters.

17. The condenser assembly as recited in claim 4, and further comprising a diffuser that diffuses a flow of air as it enters the condenser assembly and before it contacts the one or more filters.

* * * * *